US008245684B2

(12) United States Patent
Reynolds et al.

(10) Patent No.: US 8,245,684 B2
(45) Date of Patent: Aug. 21, 2012

(54) METHOD OF OIL PRESSURE CONTROL IN AN ENGINE

(75) Inventors: Michael G. Reynolds, Troy, MI (US); Bryan K. Pryor, Farmington, MI (US); William C. Albertson, Clinton Township, MI (US); Mike M. McDonald, Macomb, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 514 days.

(21) Appl. No.: 12/435,719

(22) Filed: May 5, 2009

(65) Prior Publication Data

US 2010/0284823 A1 Nov. 11, 2010

(51) Int. Cl.
*F01M 1/08* (2006.01)
*F01M 1/14* (2006.01)
*F01M 1/16* (2006.01)

(52) U.S. Cl. ..... 123/196 R; 184/6.3

(58) Field of Classification Search ..... 123/196 R; 184/6.3

See application file for complete search history.

(56) References Cited

U.S. PATENT DOCUMENTS

| | | | | |
|---|---|---|---|---|
| 4,094,293 | A | 6/1978 | Evans | |
| 5,526,783 | A * | 6/1996 | Ito et al. | 123/196 S |
| 5,655,495 | A * | 8/1997 | Richards | 123/196 S |
| 6,093,974 | A * | 7/2000 | Tabata et al. | 290/40 R |
| 6,148,789 | A * | 11/2000 | Johns | 123/196 S |
| 6,386,170 | B1 * | 5/2002 | Iwano et al. | 123/196 R |
| 7,322,800 | B2 * | 1/2008 | Roth | 417/364 |
| 7,395,802 | B2 * | 7/2008 | Riley et al. | 123/196 R |
| 2007/0103002 | A1 * | 5/2007 | Chiao et al. | 307/10.1 |

FOREIGN PATENT DOCUMENTS

| | | | |
|---|---|---|---|
| CN | 2187679 | Y | 1/1995 |
| JP | 11159366 | A * | 6/1999 |

* cited by examiner

*Primary Examiner* — Noah Kamen
*Assistant Examiner* — Grant Moubry
(74) *Attorney, Agent, or Firm* — Quinn Law Group, PLLC

(57) ABSTRACT

An engine having a fluid lubrication and control system is provided. The engine also includes a pump configured to maintain fluid pressure in the lubrication and control system when the engine is running. The engine additionally includes an accumulator in fluid communication with the lubrication and control system. The accumulator is configured to accumulate and retain fluid when the engine is running, and to discharge the fluid when the engine is not running in order to maintain fluid pressure in the lubrication and control system. A method for controlling oil pressure in the engine is also provided.

6 Claims, 4 Drawing Sheets

METHOD OF OIL PRESSURE CONTROL IN AN ENGINE

TECHNICAL FIELD

The present invention relates to control of oil pressure, and, more particularly, to controlling oil pressure in an engine of a motor vehicle.

BACKGROUND OF THE INVENTION

A typical internal combustion engine, as employed in vehicle propulsion systems, requires a circulation of pressurized fluid or oil through specially configured galleries to provide cooling and lubrication to components such as bearings and piston rings. Lubrication is generally employed to prevent physical contact between neighboring surfaces experiencing motion relative to one another. Oil pressure is also utilized to control various components, such as, for example, a camshaft phaser.

Pressurized engine oil is typically supplied by an oil pump driven mechanically by the engine's crankshaft. When the engine is shut-off, the oil pump ceases to operate, and oil pressure in the galleries rapidly diminishes. Because oil pressure requires time to be reestablished, a subsequent restart of the engine is affected without the necessary oil pressure.

Internal combustion engines are often used as part of propulsion systems in hybrid vehicles with a "start-stop" feature or function. With a "start-stop", a hybrid vehicle shuts its engine off automatically when the vehicle is either stopped or coasting, in order to conserve fuel, and is then quickly restarted when vehicle acceleration is again required. The frequency of engine starting events in a hybrid vehicle is, thus, greatly increased in comparison with a conventional, non-hybrid vehicle.

SUMMARY OF THE INVENTION

In view of the foregoing, an engine having a fluid lubrication and control system is provided. The engine includes a pump configured to maintain fluid pressure in the lubrication and control system when the engine is running. The engine also includes an accumulator in fluid communication with the lubrication and control system. The accumulator is configured to accumulate and retain fluid when the engine is running, and to discharge the fluid when the engine is not running in order to maintain fluid pressure in the lubrication and control system. The fluid lubrication and control system may include a camshaft phaser operable by fluid pressure, wherein the accumulator is configured to maintain fluid pressure to the phaser when engine is shut-off.

The fluid lubrication and control system may also include a check-valve configured to allow filling of the accumulator with fluid when the engine is running, and retain the fluid inside the accumulator when the engine is shut-off. The accumulator may additionally include a first control valve configured to selectively close to retain fluid in the accumulator when the engine is running and open to discharge the fluid from the accumulator when the engine is not running.

The engine may additionally include an electronic controller arranged or positioned relative to the engine and configured to selectively open and close the first control valve. The engine may also include a second control valve configured to selectively open to permit filling of the accumulator and close to prevent filling of the accumulator. In such a case the electronic controller is also configured to selectively open and close the second control valve.

A method for controlling oil pressure in a vehicle powertrain with a start-stop function is also provided. The method includes accumulating engine oil via an accumulator when the engine is running and retaining oil in the accumulator when the engine is shut-off. The method also includes determining whether the engine is shut-off due to a start-stop event and determining whether engine shut-off time is greater than a minimum shut-off time. Additionally, the method includes determining temperature of engine oil if the engine shut-off time is greater than the minimum shut-off time, and determining accumulator discharge time based on the determined temperature of engine oil. Furthermore, the method includes discharging engine oil via the accumulator for the determined discharge time to maintain engine oil pressure.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
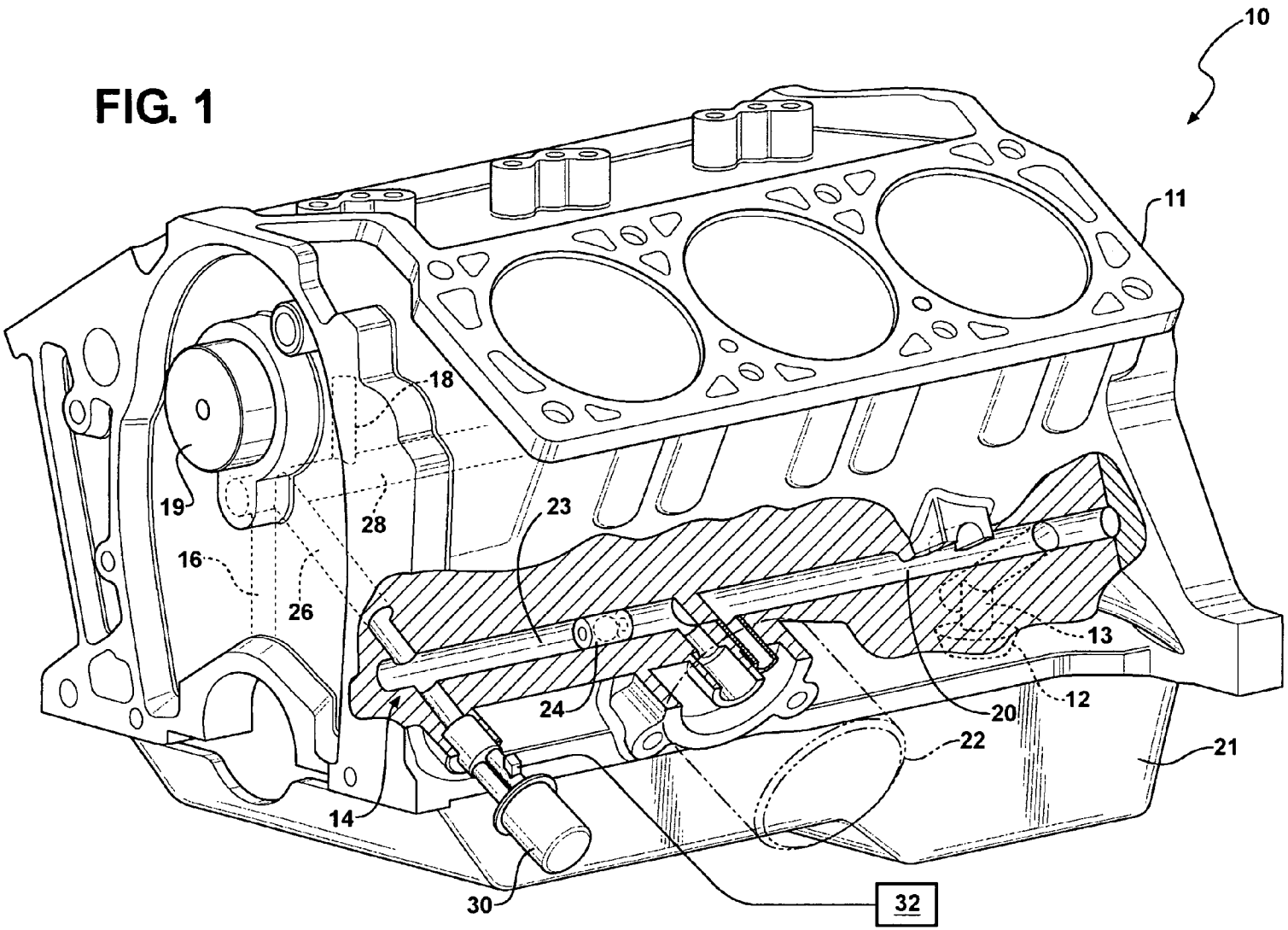
FIG. 1 is a schematic perspective illustration in partial cut-away and phantom view of a fluid lubrication and control system of an engine having an oil accumulator according to the disclosure.

Referring to the drawings in which like elements are identified with identical numerals throughout, FIG. 1 shows an engine 10 inclusive of an engine block 11 and an oil pan 21. The engine 10 includes an oil pump 12 and a fluid lubrication and control system 14. The pump 12 is driven mechanically by a crankshaft (not shown) of the engine 10, to maintain oil pressure to the fluid lubrication and control system 14 via a passage 13, when the engine is running. The fluid lubrication and control system 14 includes multiple oil passages strategically routed throughout the engine 10 for effective cooling, lubrication and control of engine components, as understood by those skilled in the art. The fluid lubrication and control system 14 includes passages 16 for feeding crankshaft bearings (not shown), and passages 18 for feeding camshaft bearings (not shown) and for supplying oil to a camshaft phaser 19. As understood by those skilled in the art, a camshaft phaser 19 is a mechanism employed to control and optimize timing of opening and closing of engine valves, thereby facilitating more efficient engine operation.

Oil pump 12 draws oil from the oil pan 21, pressurizes the oil and supplies it to the lubrication and control system 14 via a passage 20. Passage 20 delivers pressurized oil to engine oil filter 22. Filter 22 decontaminates the oil and permits it to pass into a passage 23. Passage 23 contains a check-valve 24 (if a similar check-valve is not incorporated into the filter 22), to prevent the backflow, i.e. drainage, of oil toward the pump 12 when the engine 10 is shut-off. Passage 23 delivers filtered and pressurized oil to a passage 26, which in turn delivers the oil to a main oil gallery 28. The oil gallery 28 in turn distributes the pressurized oil to passages 16 for feeding crankshaft bearings (not shown) and camshaft phaser 19, as well as to passages 18 for feeding camshaft bearings (not shown). Oil enters a component, such as a camshaft or a crankshaft bearing, through a dedicated feed aperture or channel (not shown) that has a significantly smaller cross-sectional area than that of the passages 16, 18, 26 and 28. Hence, elevated fluid pressure provided by oil pump 12 is required to force oil through such a feed aperture or channel to achieve effective lubrication of the respective component. After exiting the lubricated component, the oil generally assumes ambient pressure, and is subsequently returned to oil pan 21, mainly via gravity.

As shown, passages 23 and 26 are also fluidly connected with an oil accumulator 30. Accumulator 30 is configured to accumulate and retain oil when the engine 10 is running. Accumulator 30 is additionally capable of discharging the accumulated oil when engine 10 is not running, including when the engine is being cranked over or restarted. The accumulator 30 is controlled by an electronic controller 32 to discharge oil based on whether the engine 10 is shut-off during a "start-stop" maneuver, such as typically done in a hybrid vehicle powertrain (not shown), as understood by those skilled in the art, and how long the engine 10 remains shut-off. By discharging the oil when the pump 12 is not operational, the accumulator 30 is able to maintain oil pressure to the fluid lubrication and control system 14. Controller 32 may be an electronic control unit (ECU) that has broad control authority over the hybrid powertrain that includes engine 10.

Figure 2:
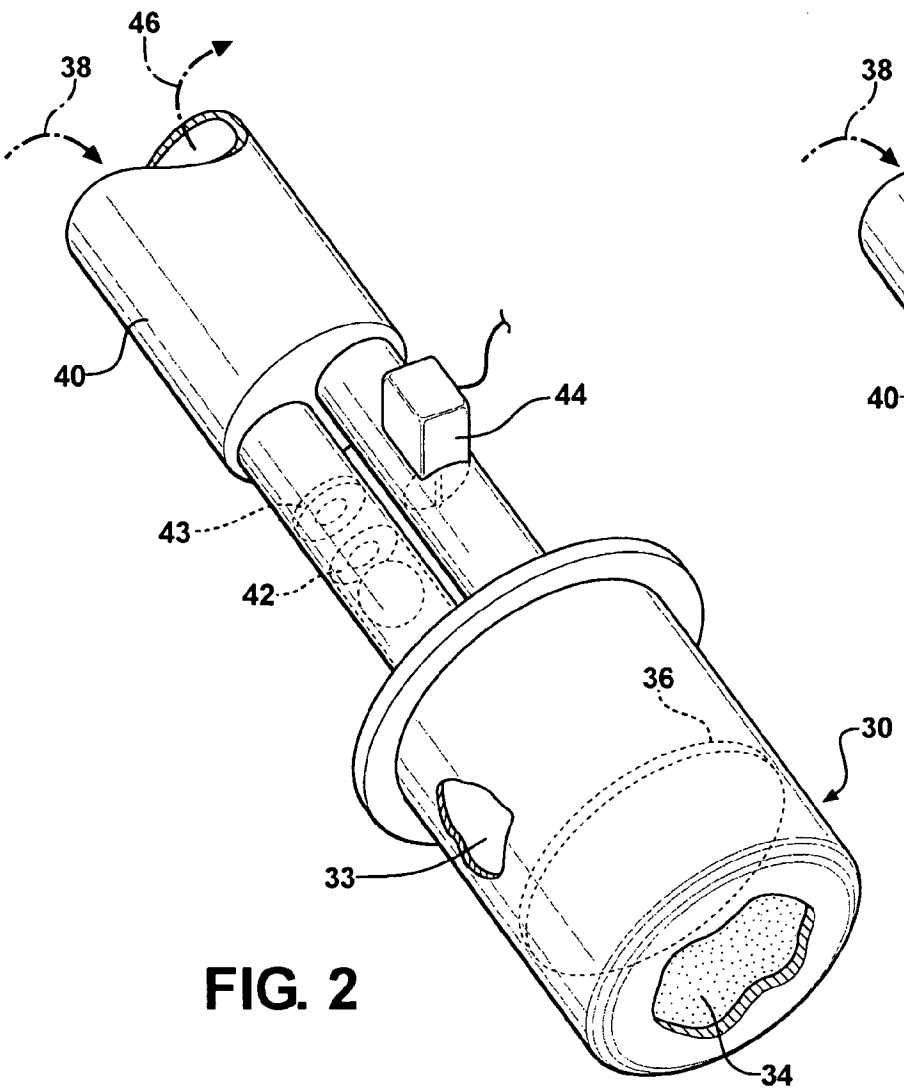
FIG. 2 is a schematic partially cut-away close-up perspective view of the oil accumulator shown in FIG. 1 having an outlet solenoid valve.

FIG. 2 schematically shows the accumulator 30. The accumulator 30 includes a fluid chamber 33 and a spring or a gas-charge chamber 34 (shown as a cut-away) that, when compressed, applies a force to a diaphragm 36. The chamber 34 is compressed, and the oil enters the accumulator 30, as represented by arrow 38, when the engine 10 is running, and when the oil pressure in passage 26 overcomes the force applied to the diaphragm 36. The oil entering the accumulator 30 passes through a cylinder 40, displaces an inlet check-valve 42 to enter the fluid chamber 33. The check-valve 42 is a single-direction flow device permitting the entry of the fluid into the fluid chamber 33, but not its escape. An orifice 43 is shown upstream of the check-valve 42. Orifice 43 is sized to regulate how much oil is diverted from passage 26 when the engine 10 is running, and hence, to control or limit the rate at which the incoming oil is delivered to fluid chamber 33.

The accumulator 30 also includes a first solenoid valve 44, which remains closed when the engine 10 is running, to permit retention of the accumulated oil inside the fluid chamber 33. When the engine 10 is shut-off, the oil pressure inside the fluid lubrication and control system 14 rapidly diminishes, and the pressure of the oil retained inside the accumulator 30 exceeds the pressure inside passage 26. Therefore, when the engine 10 is being restarted, and all the prescribed conditions, as specified with respect to FIG. 1, are met, the controller 32 directs the first solenoid valve 44 to open. When the first solenoid valve 44 is opened, the compressed chamber 34 forces the accumulated oil out through the cylinder 40, as represented by arrow 46, and into the passage 26 to feed the fluid lubrication and control system 14. Check-valve 24 prevents reverse flow through passage 23, thus sustaining oil pressure inside passage 26.

Figure 3:
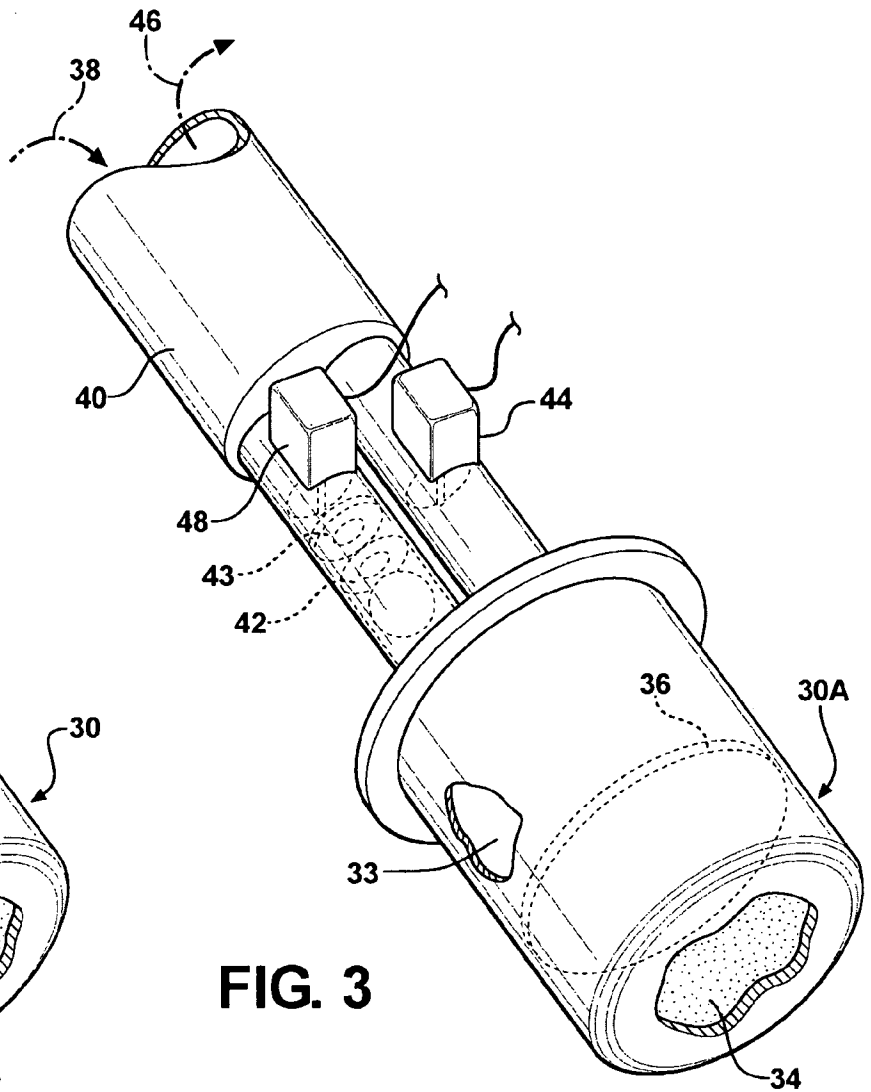
FIG. 3 is a schematic partially cut-away close-up perspective view of the oil accumulator shown in FIG. 1 having inlet and outlet solenoid valves.

FIG. 3 shows an accumulator 30A. The accumulator 30A is in most aspects identical to the accumulator 30 described in relation to FIG. 2, and similarly functions to maintain oil pressure to the fluid lubrication and control system 14 when engine 10 is shut-off. Hence, all elements of accumulator 30A that match the elements of accumulator 30 are labeled identically in FIG. 3. Accumulator 30A includes a second solenoid valve 48, which may be controlled by the controller 32 to remain either open or closed when the engine is running. Such a capability may be desired to prevent filling the fluid chamber 33 continuously, which may cause a significant drop in pressure within the fluid lubrication and control system 14. Additionally, it may be desired to prevent or interrupt filling the fluid chamber 33 during certain predetermined engine conditions, such as when oil pressure produced by pump 12 is necessary to achieve a different function.

Figure 4:
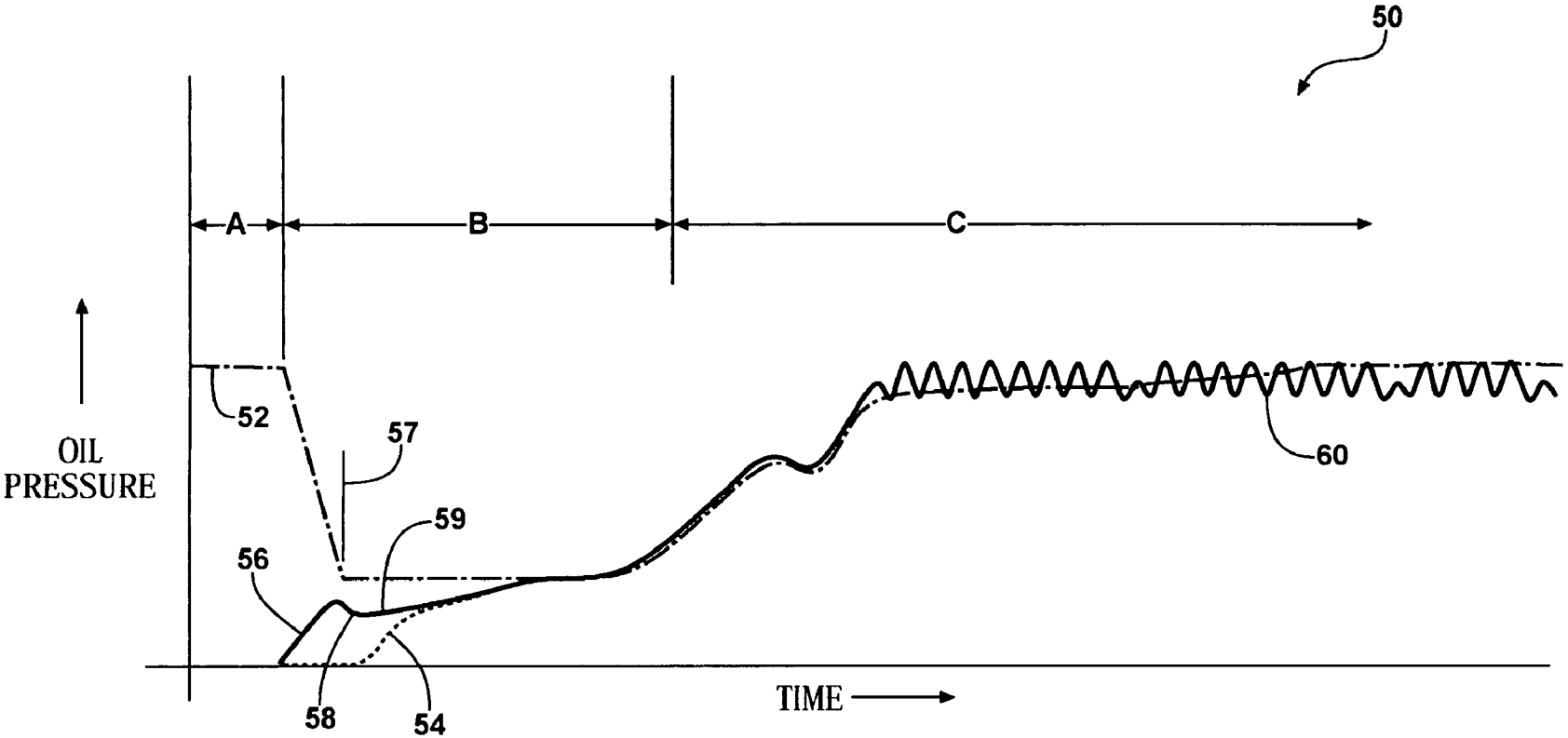
FIG. 4 is a graphical illustration of engine oil pressure versus time for an engine being restarted after a prolonged shut-off, with and without the accumulator shown in FIGS. 2 and 3.

FIG. 4 illustrates a comparison plot 50 of engine oil pressure versus time for an engine being restarted after a prolonged shut-off, with and without the accumulator shown in FIGS. 2 and 3. The following description is provided with respect to the accumulator 30 of FIG. 2, but applies equally to the accumulator 30A of FIG. 3. Trend line 52 represents oil pressure inside the accumulator 30. Trend line 54 represents oil pressure inside the fluid lubrication and control system 14 without the accumulator 30. Trend line 56 represents oil pressure inside the fluid lubrication and control system 14 with the accumulator 30 present. During time frame A, the engine 10 is shut-off and the first solenoid valve 44 is commanded closed. FIG. 4 shows the trend line 56 during time frame A as a zero differential pressure between the fluid and the surrounding ambient pressure. Cranking of the engine 10 is initiated at the start of time frame B to generate a restart after a prolonged engine shut-off that caused oil pressure inside the fluid lubrication and control system 14 to diminish below a predetermined required operating level. During time frame B, the first solenoid 44 of a previously charged accumulator 30 or 30A is actuated by the controller 32 to discharge contents of the chamber 33 to the fluid lubrication and control system 14. During time frame C, the engine 10 has been restarted, and is running.

As can be seen from the plot 50, trend line for oil pressure 54 in the fluid lubrication and control system 14 ramps up with a marked delay as the engine 10 is being started during time frame B. By comparison, trend line for oil pressure 56 in the fluid lubrication and control system 14 ramps up without any noticeable delay. Hence, the accumulator 30 is able to provide effective lubrication and control for critical engine systems during transient operation when the engine 10 is being cranked/restarted, but not yet running on its own. The trend line for oil pressure 56 additionally shows a dip 58 following a moment 57 when the first solenoid valve 44 is commanded by the controller 32 to close and shut-off oil flow from the accumulator 30. The oil pressure dip 58 is followed by a steady rise 59 as the pump 12 begins to generate pressure. Once engine 10 has been restarted, and is running during time frame C, and the pump 12 provides sufficient pressure to overcome the force of chamber 34, check-valve 42 opens to permit oil entry into fluid chamber 33, thereby recharging the accumulator 30. The trend line 56 during time frame C shows pressure fluctuations 60 in the passages of fluid lubrication and control system 14 due to typical oil pump 12 and camshaft phaser 19 operating characteristics.

Figure 5:
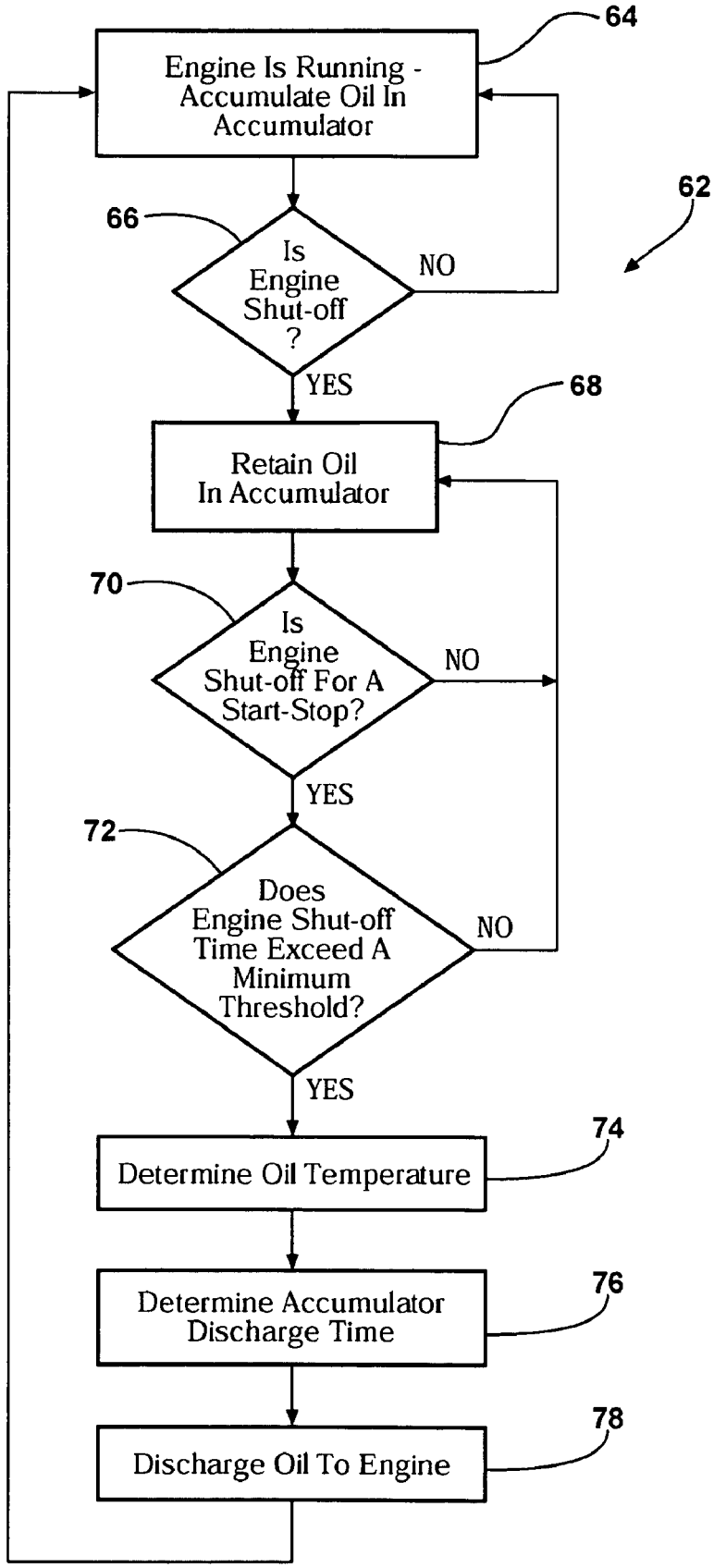
FIG. 5 schematically illustrates, in flow chart format, a method for controlling oil pressure in the fluid lubrication and control system shown in FIG. 1.

FIG. 5 depicts a method 62 for controlling oil pressure in a vehicle powertrain with a "start-stop" function, typically a hybrid powertrain that additionally employs a motor/generator to restart engine 10, and/or for driving the vehicle. The method 62 is described below with reference to both FIGS. 1 and 2. A "start-stop" function refers to the engine 10 being shut-off when engine power is not required to drive the vehicle, and subsequently being restarted when engine power is again demanded. When the engine 10 is shut-off because engine power is not required to drive the vehicle, oil pressure to the fluid lubrication and control system 14 quickly diminishes due to pump 12 being inactive. Thus, method 62 is used to more rapidly achieve sufficient oil pressure within the engine 10. Sufficient oil pressure at engine restart provides enhanced control over valve timing, as well as reduces or eliminates physical contact between neighboring moving surfaces inside the engine 10. Thus, the method 62 provides a more efficient restart and improved reliability of the engine 10 when such is utilized within a powertrain having a "start-stop" function.

The method 62 is initiated in frame 64 where engine 10 is running and accumulator 30 is commanded by controller 32 to accumulate oil. The method 62 then proceeds to frame 66. In frame 66, it is determined via controller 32, in the particular case of an ECU for the engine 10, whether the engine 10 has been shut-off. If in frame 66 it is determined that engine 10 is still running, the method 62 loops back to frame 64. Alternatively, if in frame 66 it is determined that engine 10 has been shut-off, the method proceeds to frame 68, where controller 32 commands the accumulator 30 to retain oil by keeping the first solenoid valve 44 closed. Following frame 68, the method 62 proceeds to frame 70 where the controller 32 determines whether the engine 10 was shut-off due to a "start-stop" event. If in frame 70 it is determined that the engine 10 was not shut-off due to a "start-stop" event, the method loops back to frame 68. If in frame 70 it is determined that the engine 10 was shut-off due to a "start-stop" event, the method proceeds to frame 72. In frame 72, controller 32 determines whether shut-off time of engine 10 exceeds a minimum threshold shut-off time. The minimum engine shut-off time is generally determined empirically during development of engine 10, and is indicative of a length of down time that permits engine oil pressure to not decay below a particular minimum operating level. If in frame 72 it is determined that the shut-off time of engine 10 does not exceed the minimum threshold shut-off time, the method loops back to frame 68, where the oil is retained by the accumulator 30. If in frame 72 it is determined that the shut-off time of engine 10 does exceed the minimum threshold shut-off time, the method proceeds to frame 74.

In frame 74, temperature of oil in the oil pan 21 is determined either by being sensed via a temperature sensor (not shown) or estimated by using other vehicle sensors. Following frame 74, the method proceeds to frame 76, where opening time for first solenoid valve 44, and therefore discharge time of the accumulator 30, is determined via the controller 32. The first solenoid valve 44 opening time may be determined from a look-up table entered into or accessible by the controller 32 containing an empirically established correlation between accumulator 30 discharge time and oil temperature values. At this point, the method 62 will proceed to frame 78. In frame 78, oil is discharged by the accumulator 30 for a determined period of time by opening the first solenoid valve 44 via command from the controller 32. When the oil is being discharged by accumulator 30, engine 10 receives pressurized oil for lubrication, as well as control over the camshaft phaser 19. Following discharge of accumulator 30 for the determined period of time, the discharging is ceased by closing the first solenoid valve 44 via command from the controller 32. The method 62 will then loop back to frame 64, where, following engine 10 re-start, accumulator 30 will again start to accumulate and retain oil when oil pressure provided by pump 12 exceeds the pressure inside chamber 34.

While the best modes for carrying out the invention have been described in detail, those familiar with the art to which this invention relates will recognize various alternative designs and embodiments for practicing the invention within the scope of the appended claims.

The invention claimed is:

1. A method for controlling oil pressure in a vehicle powertrain having an internal combustion engine with a start-stop function, the engine including a fluid lubrication and control system, an oil filter, and an oil pump driven by the engine to maintain fluid pressure to the lubrication and control system when the engine is running, the method comprising:

accumulating engine oil via an accumulator when the engine is running;

retaining the oil in the accumulator when the engine is shut-off;

determining whether the engine is shut-off due to a start-stop event;

determining whether engine shut-off time is greater than a minimum shut-off time;

determining a temperature of the engine oil if the engine shut-off time is greater than the minimum shut-off time;

determining an accumulator discharge time based on the determined temperature of the engine oil; and discharging the engine oil via the accumulator for the determined discharge time when the engine is not running to maintain engine oil pressure.

2. The method for controlling oil pressure of claim 1, wherein the fluid lubrication and control system includes a camshaft phaser operable by fluid pressure.

3. The method for controlling oil pressure of claim 1, further comprising limiting a rate of oil accumulation via an orifice.

4. The method for controlling oil pressure of claim 1, further comprising preventing oil from flowing back into the oil pump and into the oil filter when the engine is not running and the accumulator is discharging.

5. The method for controlling oil pressure of claim 1, wherein said determining whether the engine is shut-off due to a start-stop event, said determining whether engine shut-off time is greater than a minimum shut-off time, said determining accumulator discharge time based on the determined temperature of engine oil, and said discharging engine oil for the determined discharge time are accomplished via a controller.

6. The method for controlling oil pressure of claim 5, wherein said determining accumulator discharge time based on the determined temperature of engine oil is accomplished using a look up table programmed into the controller.

* * * * *